US011844412B2

(12) United States Patent
Yim et al.

(10) Patent No.: US 11,844,412 B2
(45) **Date of Patent: *Dec. 19, 2023**

(54) COSMETIC CONTAINER

(71) Applicants: LG HOUSEHOLD & HEALTH CARE LTD., Seoul (KR); Bang Bin Yim, Gimpo-si (KR)

(72) Inventors: Bang Bin Yim, Gimpo-si (KR); Sung Hwan Kim, Daejeon (KR); Kyung Won Kim, Daejeon (KR); Hae Yun Park, Cheongju-si (KR)

(73) Assignees: LG HOUSEHOLD & HEALTH CARE LTD., Seoul (KR); Bang Bin Yim, Gimpo-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/961,406

(22) Filed: Oct. 6, 2022

(65) Prior Publication Data

US 2023/0030871 A1 Feb. 2, 2023

Related U.S. Application Data

(63) Continuation of application No. 17/364,376, filed on Jun. 30, 2021, now Pat. No. 11,497,291, which is a (Continued)

(30) Foreign Application Priority Data

Dec. 13, 2017 (KR) ..... 10-2017-0171031

(51) Int. Cl.
*A45D 34/04* (2006.01)
*B05B 15/30* (2018.01)
(Continued)

(52) U.S. Cl.
CPC ..... *A45D 34/04* (2013.01); *B05B 11/1001* (2023.01); *B05B 11/1052* (2023.01);
(Continued)

(58) Field of Classification Search
CPC ..... A45D 34/04; A45D 2034/002; A45D 2200/056; A45D 2200/057; B05B 15/30; B05B 11/3001; B05B 11/3052
See application file for complete search history.

(56) References Cited

U.S. PATENT DOCUMENTS 5,096,094 A * 3/1992 Guilbert ..... B05B 11/3059 222/321.9
7,997,451 B2 * 8/2011 Carnacina ..... B05B 11/3049 222/321.9
(Continued)

FOREIGN PATENT DOCUMENTS

CN 101668508 A 3/2010
CN 105916404 A 8/2016
(Continued)

OTHER PUBLICATIONS

Korean Office Action for Korean Application No. 10-2018-0064415, dated Jan. 15, 2021, and English language translation thereof.

*Primary Examiner* — Jeremy Carroll
(74) *Attorney, Agent, or Firm* — Birch, Stewart, Kolasch & Birch, LLP

(57) ABSTRACT

Disclosed herein is a cosmetic container. The cosmetic container includes an inner cap coupled to a mouth of the container that accommodates contents therein, a pump coupled to the inner cap and inserted into the mouth of the container to discharge a fixed amount of contents, a push button provided in an upper portion of the inner cap, operating the pump by a push operation, and having on a side thereof a nozzle to discharge the contents, and a dip tube
(Continued)

coupled at one end thereof to the pump to communicate therewith and inclined at the other end thereof downwards in a direction of a tip of the nozzle, a tip of the dip tube being disposed on an edge of a bottom surface of the container.

10 Claims, 6 Drawing Sheets

Related U.S. Application Data continuation of application No. 16/772,468, filed as application No. PCT/KR2018/014465 on Nov. 22, 2018, now Pat. No. 11,103,044.

(51) Int. Cl.
*B05B 11/10* (2023.01)
*A45D 34/00* (2006.01)

(52) U.S. Cl.
CPC ..... *B05B 15/30* (2018.02); *A45D 2034/002* (2013.01); *A45D 2200/056* (2013.01); *A45D 2200/057* (2013.01)

(56) References Cited

U.S. PATENT DOCUMENTS

| | | | | |
|---|---|---|---|---|
| 2003/0150876 | A1* | 8/2003 | Walters | B05B 11/3059 222/321.9 |
| 2005/0023300 | A1* | 2/2005 | Schultz | B05B 11/3052 222/255 |
| 2016/0324294 | A1 | 11/2016 | Kim et al. | |
| 2018/0099299 | A1* | 4/2018 | Sun | B05B 11/3008 |

FOREIGN PATENT DOCUMENTS

| | | | |
|---|---|---|---|
| JP | 2000-62871 | A | 2/2000 |
| JP | 2016-210446 | A | 12/2016 |
| JP | 2017-105533 | A | 6/2017 |
| KR | 20-0288440 | Y1 | 9/2002 |
| KR | 20-0396402 | Y1 | 9/2005 |
| KR | 10-0889050 | B1 | 3/2009 |
| KR | 10-2012-0061258 | A | 6/2012 |
| KR | 10-2012-0107384 | A | 10/2012 |
| KR | 20-2013-0002834 | U | 5/2013 |
| KR | 10-2014-0069868 | A | 6/2014 |
| KR | 20-2015-0001417 | U | 4/2015 |
| KR | 10-2016-0031275 | A | 3/2016 |
| KR | 10-1776183 | B1 | 9/2017 |
| WO | WO 2015/011814 | A1 | 1/2015 |

* cited by examiner

COSMETIC CONTAINER

CROSS-REFERENCE TO RELATED APPLICATIONS

This application is a Continuation of U.S. application Ser. No. 17/364,376, filed on Jun. 30, 2021, which a Continuation of U.S. application Ser. No. 16/772,468 filed on Jun. 12, 2020 (now U.S. Pat. No. 11,103,044, issued on Aug. 31, 2021), which is the National Phase under 35 U.S.C. § 371 of International Application No. PCT/KR2018/014465, filed on Nov. 22, 2018, which claims the benefit under 35 U.S.C. § 119(a) to Patent Application No. 10-2017-0171031, filed in the Republic of Korea on Dec. 13, 2017, all of which are hereby expressly incorporated by reference into the present application.

TECHNICAL FIELD

The present disclosure relates to a cosmetic container. More particularly, the present disclosure relates to a cosmetic container that can completely use contents.

BACKGROUND ART

Generally, cosmetic containers for storing various types of cosmetics are manufactured in various forms according to the types of the cosmetics.

Recently, the cosmetic container is not only used for simply storing cosmetics, but also serves to precisely discharge a proper amount of cosmetics when in use while more safely storing the cosmetics for a lengthy period of time.

Such a cosmetic container is configured such that a pump is installed in an inner cap coupled to a mouth of the container storing contents therein, thus discharging a fixed amount of contents from the cosmetic container.

However, the conventional cosmetic container is problematic in that, if a small amount of contents remains in the container due to the use of the contents, a dip tube coupled to the pump is located at a central portion on a bottom surface of the container, so that the contents may not be smoothly discharged using the pump, and thus a user should discharge the remaining contents using the user's hands or other tools after opening the inner cap of the container, with the result that it is inconvenient to use the container.

Documents of Related Art (Patent Document 1) Korean U.M. Registration No. 20-0396402 (published on Sep. 21, 2005)

DISCLOSURE

Technical Problem

The present disclosure has been made to solve the above-mentioned problems and provides a cosmetic container that can completely use contents therein and improve convenience in use.

Technical Solution

According to an aspect of the present disclosure, there may be provided a cosmetic container, including an inner cap coupled to a mouth of the container that accommodates contents therein; a pump coupled to the inner cap and inserted into the mouth of the container to discharge a fixed amount of contents; a push button provided in an upper portion of the inner cap, operating the pump by a push operation, and having on a side thereof a nozzle to discharge the contents; and a dip tube coupled at a first end thereof to the pump to communicate therewith and inclined at a second end thereof downwards in a direction of a tip of the nozzle, a tip of the dip tube being disposed on an edge of a bottom surface of the container.

The tip of the nozzle and the tip of the second end of the dip tube may be located on the same imaginary plane perpendicular to the bottom surface of the container.

In order to fix a position of the push button to the inner cap, a first locking protrusion may be formed on an outer wall of the push button to protrude outwards, and a first locking groove may be correspondingly formed in an inner wall of the inner cap so that the first locking protrusion is inserted into the first locking groove.

The pump may include a housing formed such that an upper end thereof is coupled to the inner cap and a lower end thereof protrudes to be inserted into the mouth, a first end of the dip tube being coupled to the lower end of the housing to communicate therewith, so that the contents are introduced through a first contents inlet port formed in a bottom surface of the housing into an accommodating space defined in the housing; a piston inserted into the upper end of the housing and moving up and down while being in close contact with an inner wall of the housing, a first path being longitudinally defined therein to communicate with the accommodating space; and a piston guide member disposed in the housing such that an upper end thereof supports the push button and a lower end thereof is inserted into the inner cap, and moving up and down along with the piston in a state where an upper end of the piston is inserted into the lower end of the piston guide member, a second path being longitudinally defined in the piston guide member to communicate with the first path, with a contents outlet port being formed on an upper surface of the piston guide member to discharge the contents, wherein, in order to fix a position of the housing to the inner cap, a flange having a second locking protrusion that protrudes upwards is formed on the upper end of the housing, and a second locking groove is formed in the inner cap so that the second locking protrusion is inserted into the second locking groove.

A first partition wall having a shape of a hollow pipe and inclined downwards in the direction of the tip of the nozzle may extend from the lower end of the housing, and the first end of the dip tube may be inserted into the first partition wall, so that the second end of the dip tube may be inclined downwards in the direction of the tip of the nozzle and the tip of the dip tube may be disposed on the edge of the bottom surface of the container.

An end of the first partition wall and the tip of the nozzle may be located on the same imaginary plane perpendicular to the bottom surface of the container.

The inner cap may include a second partition wall of a hollow pipe shape, the piston guide member being inserted into the second partition wall, a lower end of the second partition wall being disposed inside the housing, and a undercut processing area may be formed in the lower end of the piston guide member, a third locking protrusion may be formed on a lower end of the undercut processing area and protrudes outwards to be caught by the lower end of the second partition wall, a first cut groove may be formed in the lower end of the undercut processing area in a direction from the lower end of the piston guide member to the upper end thereof, and a second cut groove may be continuously formed above the first cut groove to be spaced apart therefrom.

The piston may include a piston rod formed in a shape of a column, and having the first path that is longitudinally formed therein and a second contents inlet port that is formed in an outer wall thereof to introduce the contents accommodated in the accommodating space into the first path; and a shield member disposed between the piston guide member and the piston rod, an upper end of the shield member being inserted into the lower end of the piston guide member, an upper end of the piston rod being inserted into a lower end of the shield member, so that the shield member causes the second contents inlet port to be exposed so that the contents are introduced into the second contents inlet port when the piston rod moves down, and the shield member covers the second contents inlet port to prevent the contents from being introduced into the second contents inlet port when the piston rod moves up.

A fourth locking protrusion may be formed on the lower end of the piston rod, and may protrude outwards to be caught by the lower end of the shield member.

The pump may further include a spring member fitted over the piston guide member to elastically support the piston guide member and the push button; and a check valve installed in the housing, and coming into close contact with the bottom surface of the housing to open or close the first contents inlet port.

Advantageous Effects

According to an embodiment of the present disclosure, when a small amount of contents remains in a container, a tip of a nozzle is placed to point outwards of the hand, the nozzle is located to be inclined downwards, and then a dip tube coupled to a pump to communicate therewith is disposed to be inclined downwards in the direction of the tip of the nozzle that discharges the contents, in consideration of the use habits of a user pressing a push button, and a tip of the dip tube is located at an edge of a bottom surface of the container, thus allowing contents in the container to be completely used.

Furthermore, according to an embodiment of the present disclosure, a tip of a nozzle and a tip of the other end of a dip tube are fixedly located on the same imaginary plane perpendicular to a bottom surface of a container, thus improving convenience in use.

DETAILED DESCRIPTION OF THE INVENTION

Figure 1:
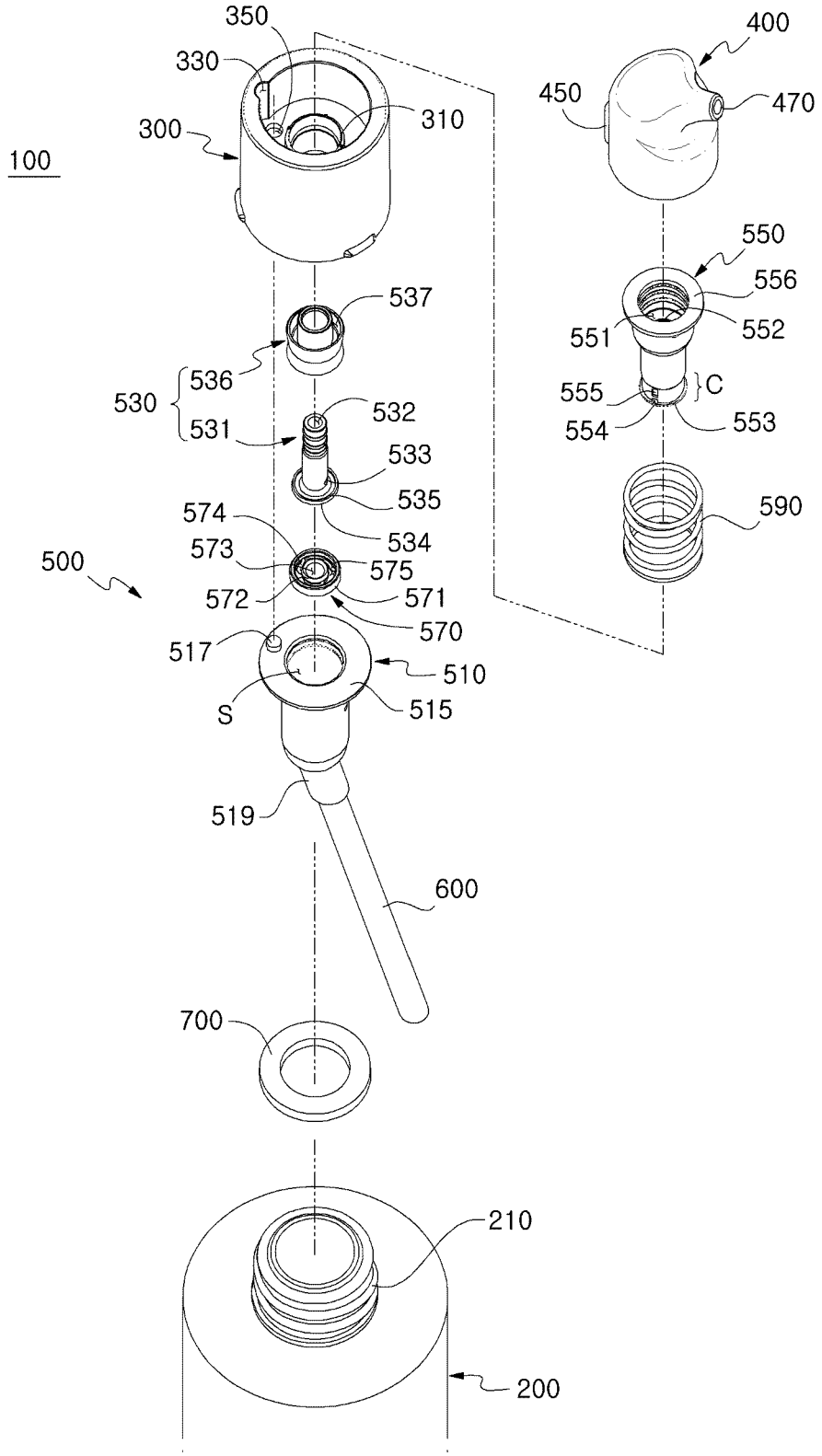
FIG. 1 is an exploded perspective view of a cosmetic container in accordance with the present disclosure.

In order to fully understand the present disclosure, the operational advantages of the present disclosure, and objectives achieved by the implementation of the present disclosure, preferred embodiments of the present disclosure will be described from the following detailed description when taken in conjunction with the accompanying drawings.

Hereinafter, preferred embodiments of the present disclosure will be described in detail with reference to the accompanying drawings. The same reference numerals shown in the drawings will denote the same members.

Figure 2:
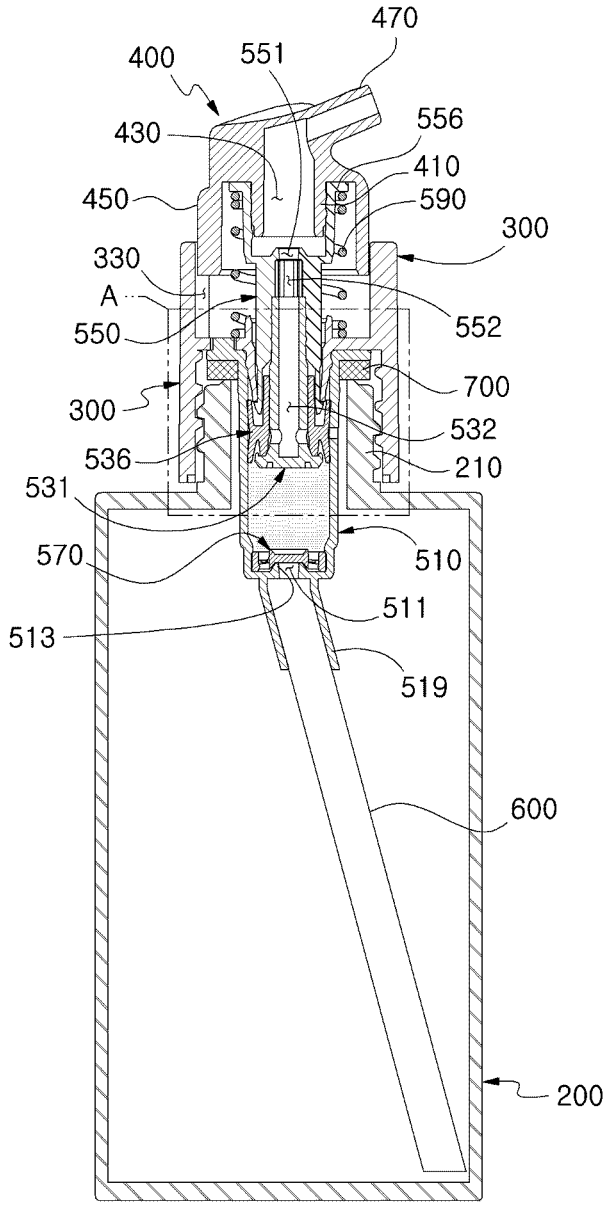
FIG. 2 is a sectional view of the cosmetic container when being assembled in accordance with the present disclosure.
Figure 3:
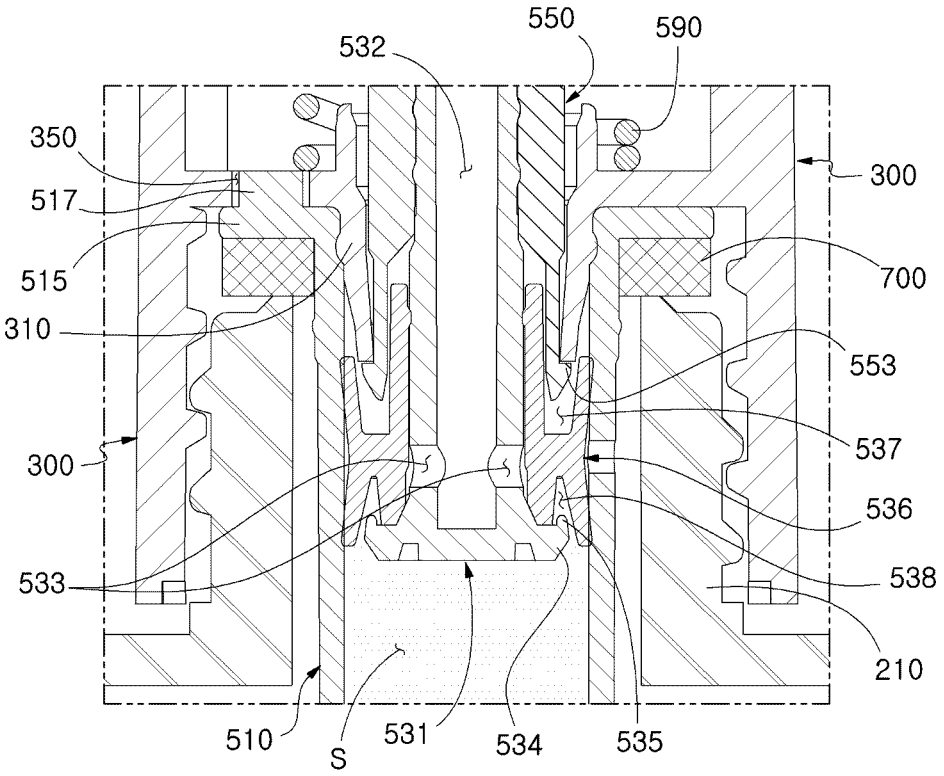
FIG. 3 is an enlarged view of portion A of FIG. 2.
Figure 4:
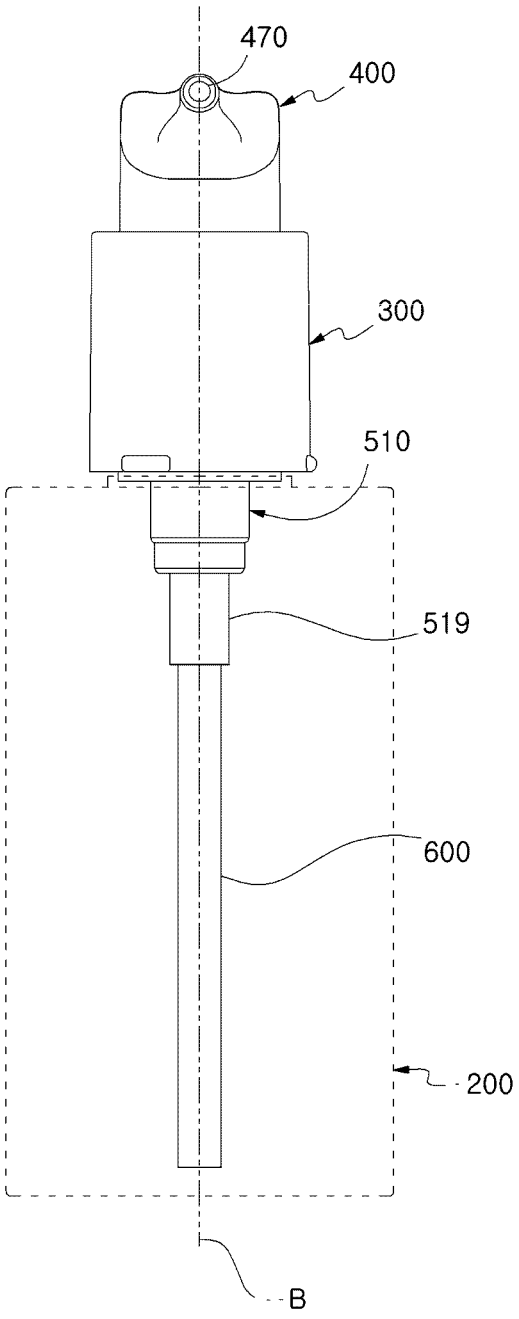
FIG. 4 is a diagram showing the positions of a nozzle, a first partition wall, and a dip tube in accordance with the present disclosure.

FIG. 1 is an exploded perspective view of a cosmetic container in accordance with the present disclosure, FIG. 2 is a sectional view of the cosmetic container when being assembled in accordance with the present disclosure, FIG. 3 is an enlarged view of portion A of FIG. 2, and FIG. 4 is a diagram showing the positions of a nozzle, a first partition wall, and a dip tube in accordance with the present disclosure.

Referring to FIGS. 1 to 3, the cosmetic container 100 in accordance with the present disclosure includes an inner cap 300 coupled to a mouth 210 of the container 200 that accommodates contents therein, a pump 500 coupled to the inner cap 300 and inserted into the mouth 210 of the container 200 to discharge a fixed amount of contents, a push button 400 provided in an upper portion of the inner cap 300, operating the pump 500 by a push operation, and having on a side thereof a nozzle 470 to discharge the contents, and a dip tube 600 coupled at one end thereof to the pump 500 to communicate therewith, the other end being inclined downwards at a predetermined angle in a direction of a tip of the nozzle 470, a tip of the dip tube being disposed on an edge of a bottom surface of the container 200.

When a small amount of contents remains in the container 200, a user usually tilts the container 200 while holding the container 200 in the user's hand, and presses the push button 400 with the tip of the nozzle 470 pointing outwards of the hand, thus discharging the contents.

Thus, according to the present disclosure, in consideration of the user's habits, in order to smoothly discharge the contents even when a small amount of contents remains in the container 200, the dip tube 600 is oriented to be inclined downwards at a predetermined angle in the direction of the tip of the nozzle 470, and the tip of the dip tube 600 is located at the edge on the bottom surface of the container 200. Thus, the contents in the container 200 can be completely used.

The inner cap 300 according to this embodiment is detachably coupled to the mouth 210 of the container 200 in the state where the pump 500 is coupled to the inner cap, and serves to support the pump 500.

A second partition wall 310 of a hollow pipe shape is formed in a central portion of the inner cap 300, and a piston guide member 550 of the pump 500 that will be described later is inserted into an upper portion of the inner cap 300 through the second partition wall 310. Further, by the push operation of the push button 400 in the second partition wall 310, the piston guide member 550 slides up and down in a height direction.

The moving range of the piston guide member 550 is limited by the second partition wall 310. This is because a third locking protrusion 553 protruding outwards from a lower end of the piston guide member 550 is caught by a lower end of the second partition wall 310 while the piston guide member 550 moves up and down in the second partition wall 310, thus limiting the upward movement of the piston guide member 550.

Furthermore, a housing 510 of the pump 500 that will be described later is inserted and coupled to a lower side of the inner cap 300. Thus, the second partition wall 310 is disposed between the housing 510 and the piston guide member 550. In other words, the housing 510 is disposed outside the second partition wall 310, and the piston guide member 550 is disposed inside the second partition wall 310.

Meanwhile, if the inner cap 300 is fastened to the mouth 210 of the container 200 in a screw-type fastening method, in order to prevent the contents in the container 200 from leaking out, an O-ring 700 of a rubber material may be provided to come into close contact with a lower surface of a first flange 515 of the housing 510 and an upper surface of the mouth 210.

The push button 400 according to this embodiment is provided in the upper portion of the inner cap 300, is connected to the pump 500, and serves to operate the pump 500 by the push operation. The nozzle 470 is provided on a side of the push button 400 to discharge the contents.

Moreover, a third partition wall 410 of a hollow pipe shape is formed in the push button 400. A third path 430 is longitudinally formed in the third partition wall 410 to communicate with a second path 552 that is defined in the piston guide member 550.

Meanwhile, unlike the related art, according to this embodiment, in order to prevent the push button 400 from being rotated in the upper portion of the inner cap 300 and fix the position of the push button 400 to the inner cap 300, a first locking protrusion 450 is formed on an outer wall of the push button 400 to protrude outwards and a first locking groove 330 is correspondingly formed in an inner wall of the inner cap 300 so that the first locking protrusion 450 is inserted into the first locking groove 330. The first locking groove 330 is formed long to extend downwards from the upper end of the inner cap 300. Thus, if the push button 400 is coupled to the inner cap 300, the first locking protrusion 450 is inserted by sliding from an upper position of the first locking groove 330 to a lower position thereof.

Therefore, as the first locking protrusion 450 engages with the first locking groove 330, a position where the push button 400 is coupled to the inner cap 300 is fixed and simultaneously a position of the nozzle 470 provided on the push button 400 is also fixed.

The pump 500 according to this embodiment serves to discharge a fixed amount of contents from the container 200.

To be more specific, the pump 500 includes the housing 510, a piston 530, the piston guide member 550, a spring member 590, and a check valve 570. The housing 510 is formed such that an upper end thereof is coupled to the inner cap 300, a lower end thereof protrudes to be inserted into the mouth 210 of the container 200, and one end of the dip tube 600 is coupled to the lower end of the housing 510 to communicate therewith, so that contents are introduced through a first contents inlet port 511 formed in a bottom surface into an accommodating space S defined therein. The piston 530 is inserted into the upper end of the housing 510, moves up and down while being in close contact with the inner wall of the housing 510, and has a first path 532 that is longitudinally defined therein to communicate with the accommodating space S. An upper end of the piston guide member 550 supports the push button 400, and a lower end thereof is inserted into the inner cap 300 to be disposed in the housing 510. In a state where the upper end of the piston 530 is inserted into the lower end of the piston guide member 550, the piston guide member 550 moves up and down along with the piston 530. The piston guide member 550 has a second path 552 that is longitudinally defined therein to communicate with the first path 532, with a contents outlet port 551 being formed on an upper surface of the piston guide member 550 to discharge the contents. The spring member 590 is fitted over the piston guide member 550 to elastically support the piston guide member 550 and the push button 400. The check valve 570 is installed in the housing 510 and is in contact with the bottom surface of the housing 510 to open or close the first contents inlet port 511.

The housing 510 according to this embodiment forms the accommodating space S to accommodate the contents therein, and serves to provide a space in which the piston 530 and the piston guide member 550 longitudinally slide up and down while being inserted into the housing 510.

A first flange 515 coupled to the inner cap 300 is formed on the upper end of the housing 510, and the lower end of the housing 510 protrudes to be inserted into the mouth 210 of the container 200. The upper end of the housing 510 is inserted into the lower side of the inner cap 300 to be disposed outside the second partition wall 310, and the first flange 515 formed on the upper end of the housing 510 is inserted into the inner cap 300.

Meanwhile, according to this embodiment, in order to prevent the housing 510 coupled to the inner cap 300 from being rotated and thereby fix the position of the dip tube 600 coupled to the lower end of the housing 510, a second locking protrusion 517 is formed on the upper surface of the first flange 515 to protrude upwards, and a second locking groove 350 is correspondingly formed in the inner cap 300 so that the second locking protrusion 517 is inserted into the second locking groove 350. Therefore, as the second locking protrusion 517 engages with the second locking groove 350, a position of the housing 510 relative to the inner cap 300 is fixed and simultaneously a position of the dip tube 600 coupled to the lower end of the housing 510 and disposed in the container 200 is also fixed.

Moreover, the first contents inlet port 511 is formed in the bottom surface of the housing 510 to introduce the contents contained in the container 200 into the housing 510. The contents introduced through the first contents inlet port 511 into the housing 510 are accommodated in the accommodating space S defined between the bottom surface in the housing 510 and the lower end of the piston 530.

In the state where the piston 530 according to this embodiment is inserted into the housing 510 and is in close contact with an inner wall of the housing 510, the piston 530 slides up and down in the longitudinal direction of the housing 510, so that contents accommodated in the accommodating space S are discharged to the nozzle 470 and the contents accommodated in the container 200 are introduced into the accommodating space S.

To be more specific, the piston 530 includes a piston rod 531 and a shield member 536. The piston rod 531 is formed in the shape of a column, and has the first path 532 that is longitudinally formed therein and a second contents inlet port 533 that is formed in an outer wall thereof to introduce the contents accommodated in the accommodating space S into the first path 532. The shield member 536 is disposed between the piston guide member 550 and the piston rod 531. An upper end of the shield member 536 is inserted into a lower end of the piston guide member 550, and an upper end of the piston rod 531 is inserted into a lower end of the shield member 536.

The piston rod 531 is formed in the shape of the column. Since a lower end of the piston rod 531 is disposed in the housing 510 and an upper end thereof is inserted into the piston guide member 550, the piston rod 531 and the piston guide member 550 move up and down together in a height direction.

A fourth locking protrusion 534 is formed on the lower end of the piston rod 531 to be caught by the lower end of the shield member 536 that will be described later. If the piston rod 531 moves down in the housing 510 in conjunction with the push button 400, the contents accommodated in the housing 510 are introduced into the second contents inlet port 533 and then are moved to the nozzle 470 to be discharged therethrough. If the piston rod 531 moves up in the housing 510, the contents accommodated in the housing 510 are prevented from being introduced into the second contents inlet port 533. At this time, the moving range of the piston rod 531 is limited by the height of the shield member 536. In other words, the fourth locking protrusion 534 protruding outwards from the lower end of the piston rod 531 is caught by the lower end of the shield member 536, thus restricting the upward movement of the piston rod 531.

The shield member 536 is disposed between the piston guide member 550 and the piston rod 531, and is moved up and down along with the piston guide member 550 and the piston rod 531 in conjunction with the push button 400.

A first insert groove 537 is formed in the upper end of the shield member 536 so that the lower end of the piston guide member 550 is inserted into the first insert groove to come into close contact therewith. Therefore, when the piston guide member 550 moves down in conjunction with the push button 400, the lower end of the piston guide member 550 is inserted into the first insert groove 537 to come into close contact therewith, thus maintaining air-tightness. This can prevent the contents from leaking out, when the contents are discharged through the second contents inlet port 533 of the piston rod 531 and the second path 552 along the second path 552 of the piston guide member 550.

Furthermore, a second insert groove 538 is formed in the lower end of the shield member 536 so that an insert protrusion 535 bent upwards from an end of the fourth locking protrusion 534 of the piston rod 531 is inserted into the second insert groove 538. Therefore, when the push button 400 is released, so that the piston rod 531 moves up, the insert protrusion 535 of the piston rod 531 is inserted into the second insert groove 538 to come into close contact therewith, thus maintaining air-tightness and preventing the contents from flowing into the second contents inlet port 533 of the piston rod 531.

As such, when the piston rod 531 moves down, the shield member 536 causes the second contents inlet port 533 to be exposed so that the contents are introduced into the second contents inlet port 533. When the piston rod 531 moves up, the shield member 536 covers the second contents inlet port 533 to prevent the contents from being introduced into the second contents inlet port 533.

The piston guide member 550 according to this embodiment is disposed between the push button 400 and the piston 530 to connect the push button 400 and the piston 530 to each other, and functions to move the piston 530 up and down by the push operation of the push button 400.

The push button 400 is disposed on the upper portion of the piston guide member 550, and a second flange 556 is formed on the upper end of the piston guide member 550 to support the push button 400. The second flange 556 is inserted into the lower side of the push button 400 to support the push button 400, and simultaneously is coupled to the push button 400. Thus, the piston guide member 550 and the push button 400 are connected to each other by the second flange 556 to be operated in conjunction with each other.

Meanwhile, the spring member 590 is fitted over the piston guide member 550 to elastically support the piston guide member 550 and the push button 400. To be more specific, the spring member 590 is connected at one end thereof to the lower surface of the second flange 556 and connected at the other end thereof to the inner cap 300, thus elastically supporting the piston guide member 550 and the push button 400. If a user presses the push button 400, the piston guide member 550 and the piston 530 are moved down in conjunction with the push button 400, so that the contents are discharged. Meanwhile, if the push button 400 is released, the spring member 590 is restored to its original state, so that the piston guide member 550 and the piston 530 are moved up, and thereby the discharge of the contents is prevented.

Moreover, the lower end of the piston guide member 550 is inserted into and penetrates the second partition wall 310 of the inner cap 300 to be disposed in the housing 510, and the lower end of the piston guide member 550 is caught by the second partition wall 310.

According to this embodiment, a undercut processing area C is formed in the lower end of the piston guide member 550 so that the lower end of the piston guide member 550 may be easily inserted into the second partition wall 310. At least one cut groove 554 or 555 is longitudinally formed in the undercut processing area C of the piston guide member 550. Furthermore, the third locking protrusion 553 protruding outwards is formed on the lower end of the undercut processing area C to be caught by the lower end of the second partition wall 310.

The cut groove 554 or 555 induces a tension action at the lower end of the piston guide member 550, thus allowing the lower end of the piston guide member 550 to be easily inserted into the second partition wall 310 of the inner cap 300, and improving the assemblability of the piston guide member 550 and the inner cap 300.

Furthermore, in this embodiment, the first cut groove 554 may be formed in the lower end of the undercut processing area C to extend in a direction from the lower end of the piston guide 550 to the upper end thereof, and the second cut groove 555 may be continuously formed above the first cut groove 554 to be spaced apart therefrom. As such, the first cut groove 554 and the second cut groove 555 are formed in the undercut processing area C to be spaced apart from each other in the direction of height, and the lower end of the piston guide member 550 is modified to correspond to widths of the first cut groove 554 and the second cut groove 555, and then the lower end of the piston guide member 550 is inserted into the second partition wall 310. This increases elastic force for restoring the lower end of the piston guide member 550 to its original state by the tension action, after the piston guide member 550 is inserted into the second partition wall 310.

After the lower end of the piston guide member 550 is inserted into the second partition wall 310, the third locking protrusion 553 is caught by the lower end of the second partition wall 310, so that the piston guide member 550 and the inner cap 300 are assembled with each other.

Meanwhile, in order to prevent the piston guide member 550 from being moved in a direction opposite to a direction in which it is inserted into the second partition wall 310 and to prevent the lower end of the piston guide member 550 from disengaging from the second partition wall 310 by the tension action of the first cut groove 554 and the second cut groove 555 after the lower end of the piston guide member 550 and the second partition wall 310 engage with each other, the inner wall of the first insert groove 537 formed in the upper end of the shield member 536 according to this embodiment is disposed between the piston guide member 550 and the piston rod 531.

After the lower end of the piston guide member 550 is inserted into the second partition wall 310, the shield member 536 and the piston rod 531 are sequentially inserted into the lower end of the piston guide member 550, so that the inner wall of the first insert groove 537 formed in the upper end of the shield member 536 comes into close contact with the inner wall of the lower end of the piston guide member 550 on which the undercut processing area C is formed. Hence, it is possible to prevent the lower end of the piston guide member 550 in which the first cut groove 554 and the second cut groove 555 are formed from being contracted, thus preventing the piston guide member 550 and the second partition wall 310 from disengaging from each other.

Further, as described above, since the upper end of the piston rod 531 is inserted into the lower end of the piston guide member 550, the piston guide member 550 and the piston rod 531 are moved up and down together. Furthermore, since the third locking protrusion 553 is caught by the lower end of the second partition wall 310 while the piston guide member 550 moves up and down in the second partition wall 310, the moving range of the piston guide member 550 is limited.

The linear second path 552 is longitudinally formed in the piston guide member 550 to communicate with the first path 532 of the piston 530. Furthermore, the contents outlet port 551 is formed in the upper surface of the piston guide member 550 to discharge the contents moving along the second path 552.

Meanwhile, the third partition wall 410 of the hollow pipe shape is formed in the push button 400 to be inserted into the upper portion of the piston guide member 550. Further, the linear third path 430 is longitudinally formed in the third partition wall 410 to communicate with the second path 552. Thus, after the contents accommodated in the accommodating space S of the housing 510 are vertically moved up along the first path 532, the second path 552, the contents outlet port 551, and the third path 430 without distortion by the push operation of the push button 400, the contents are discharged through the nozzle 470 provided on the push button 400.

The check valve 570 according to this embodiment is installed in the housing 510 to open or close the contents inlet port by the push operation of the push button 400.

The check valve 570 is installed to come into close contact with the bottom surface in the housing 510 in which the first contents inlet port 511 is formed.

As shown in FIG. 1, the check valve 570 includes an annular ring 571 that is coupled to the interior of the housing 510, an open and close part 572 that is provided in a center of the ring 571, corresponds to the size of the contents inlet port, and has a recess 573 that is formed in a central portion thereof to have a vertical symmetrical structure, and a plurality of annular strips 574 that are connected at first ends thereof to the ring 571 and connected at second ends thereof to the open and close part 572 to connect the ring 571 and the open and close part 572 with each other, with an inflow hole 575 being formed between the ring 571 and the open and close part 572 to introduce the contents.

The ring 571 is pressed into the housing 510 to come into close contact with the bottom surface in the housing 510, so that the ring 571 is coupled to the housing 510. A projection 513 is formed on the bottom surface of the housing 510 in which the contents inlet port is formed, and protrudes in a shape corresponding to that of the recess 573 to be inserted into and come into close contact with the recess 573.

Moreover, the projection 513 is formed on the bottom surface of the housing 510 in which the contents inlet port opposite to the recess 573 formed in the central portion of the open and close part 572 is formed, and protrudes in the shape corresponding to that of the recess 573 to be inserted into and come into close contact with the recess 573.

The check valve 570 is operated as follows: if the push button 400 is moved up to be restored to its original position by the spring member 590, the piston guide member 550 and the piston rod 531 are moved up, and the open and close part 572 is moved up by vacuum pressure. Thus, the first contents inlet port 511 is opened, and the contents are moved along the inflow hole 575 to fill the accommodating space S of the housing 510.

In contrast, if the piston guide member 550 and the piston rod 531 are moved down by pressing the push button 400, the contents accommodated in the accommodating space S pass through the second contents inlet port 533, the first path 532, the second path 552, the contents outlet port 551, and the third path 430 to be discharged through the nozzle 470. Furthermore, if the piston 530 moves down, the open and close part 572 of the check valve 570 is moved down by pressure acting on the accommodating space S via the piston 530, thus closing the first contents inlet port 511 and preventing the contents from being moved to the container 200.

The dip tube 600 according to this embodiment serves as a path to move the contents accommodated in the container 200 to the pump 500.

As shown in FIG. 2, one end of the dip tube 600 is coupled to the lower end of the housing 510 to communicate therewith, and the other end of the dip tube 600 is disposed to be inclined downwards at a predetermined angle, with the tip of the dip tube being located on the edge of the bottom surface of the container 200. As described above, if a small amount of contents remains in the container 200, the tip of the other end of the dip tube 600 is located on the edge of the bottom surface of the container 200 in consideration of a user's habits using the contents by tilting the container 200.

Furthermore, generally, since the push button 400 is pressed in a state where the tip of the nozzle 470 points outwards of the hand with the user holding the container 200 in his or her hand, the tip of the other end of the dip tube 600 is disposed in the direction of the tip of the nozzle 470 to be inclined downwards at a predetermined angle.

As shown in FIG. 4, in order to completely use a small amount of contents remaining in the container 200, the tip of the nozzle 470 and the tip of the other end of the dip tube 600 are located on the same imaginary plane B perpendicular to the bottom surface of the container 200. That is, the imaginary plane B connecting the tip of the nozzle 470 and the tip of the other end of the dip tube 600 is perpendicular to the bottom surface of the container 200.

Meanwhile, according to this embodiment, when the dip tube 600 is coupled to the lower end of the housing 510 to communicate therewith, the dip tube 600 is oriented in the direction of the tip of the nozzle 470 to be inclined downwards at a predetermined angle. To this end, the first partition wall 519, which has the shape of the hollow pipe and is inclined downwards at a predetermined angle in the direction of the tip of the nozzle 470, extends from the lower end of the housing 510. As shown in FIG. 4, the end of the first partition wall 519 and the tip of the nozzle 470 are located on the same imaginary plane B perpendicular to the bottom surface of the container 200. In other words, the imaginary plane B connecting the end of the first partition wall 519 and the tip of the nozzle 470 is perpendicular to the bottom surface of the container 200.

The first partition wall 519 serves as a guide so that the dip tube 600 is oriented in the direction of the tip of the nozzle 470 to be inclined downwards at a predetermined angle and the tip of the other end of the dip tube 600 is located on the edge of the bottom surface of the container 200. That is, if one end of the dip tube 600 is fixedly inserted into the first partition wall 519, the dip tube 600 is oriented in the direction of the tip of the nozzle 470 to be inclined downwards at a predetermined angle and the tip of the other end of the dip tube 600 is located on the edge of the bottom surface of the container 200.

As described above, the cosmetic container 100 according to the present disclosure is configured such that the position of the push button 400 to the inner cap 300 is fixed, the position of the housing 510 to the inner cap 300 is fixed, the dip tube 600 is oriented in the direction of the tip of the nozzle 470 to be inclined downwards at a predetermined angle, and the tip of the other end of the dip tube 600 is located on the edge of the bottom surface of the container 200. Thus, when a small amount of contents remains in the container 200, the tip of the nozzle 470 is oriented to point outwards of the hand and the nozzle 470 is located to be inclined downward at a predetermined angle. Then, it is possible to completely use the contents in the container 200 simply by pressing the push button 400, thus improving convenience in use.

The use of the cosmetic container 100 according to the present disclosure configured as such will be described below.

Figure 5:
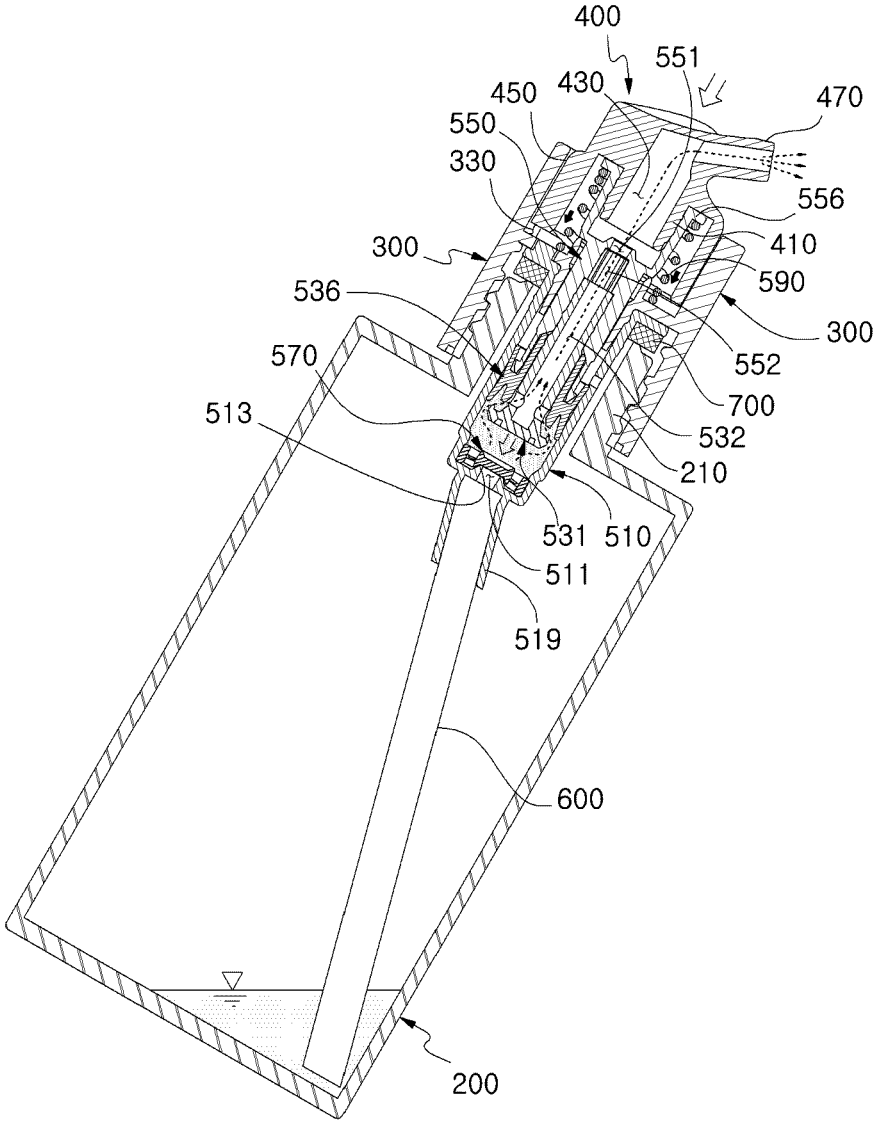
FIGS. 5 and 6 are diagrams showing the state in which the cosmetic container in accordance with the present disclosure is used.
Figure 6:
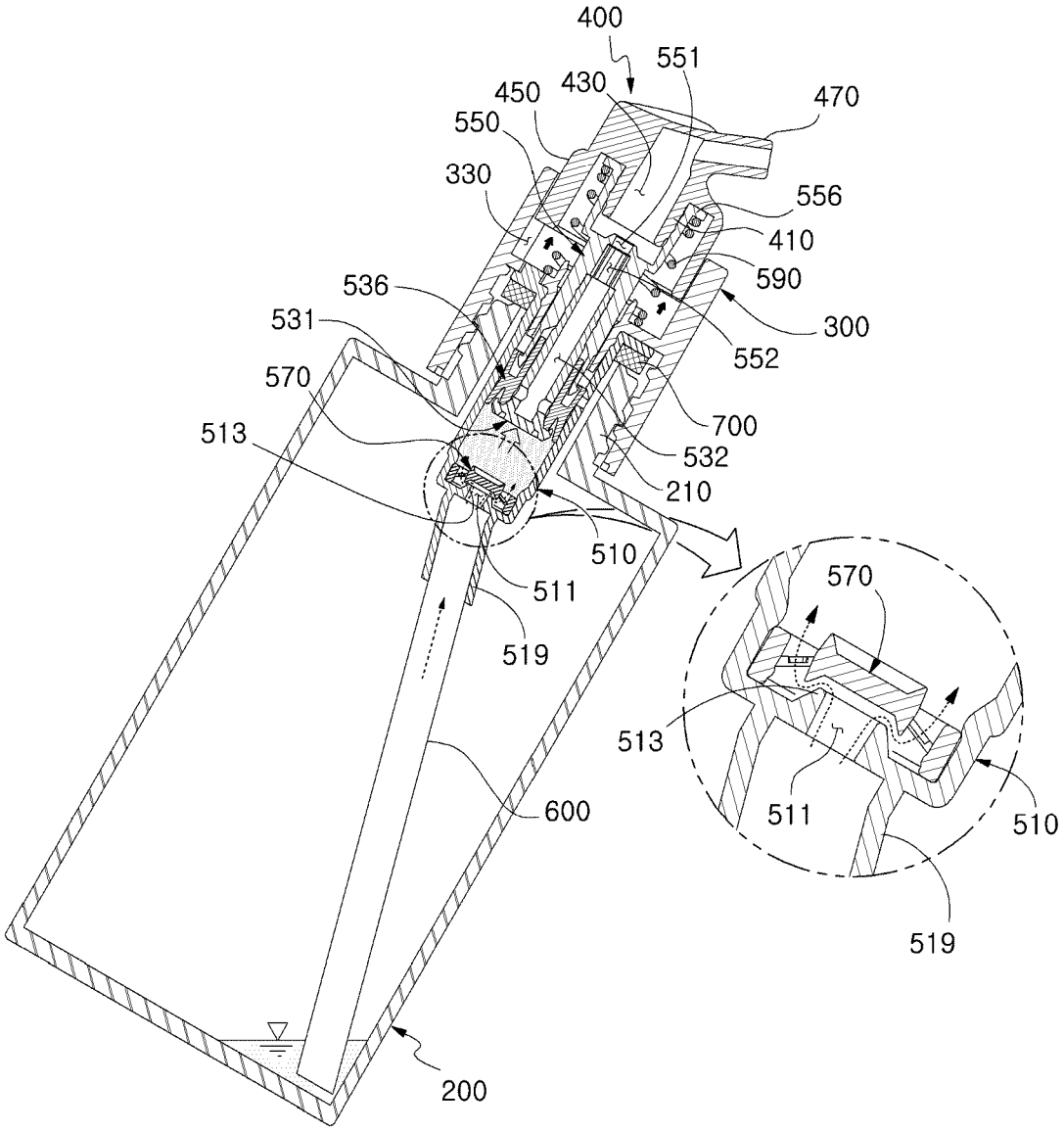

FIGS. 5 and 6 are diagrams showing the state in which the cosmetic container in accordance with the present disclosure is used.

Especially when a small amount of contents remains in the bottom surface of the container 200, so that the tip of the dip tube 600 is not immersed in the contents, the contents may not be discharged to the pump 500. In this case, after a user opens the inner cap 300 of the container 200, the remaining contents may be discharged using the hand or other tools.

In order to solve a user's inconvenience, as shown in FIGS. 5 and 6, the cosmetic container 100 according to the present disclosure enables a small amount of contents to be discharged simply by tilting the container 200 with the user holding the container 200 in his or her hand and pressing the push button 400 with the tip of the nozzle 470 pointing outwards of the hand, thus improving convenience in use and allowing the contents to be completely used.

An operation of discharging the contents when a small amount of contents remains in the container 200 is as follows.

As shown in FIG. 5, the user tilts the container 200 with the user holding the container 200 in his or her hand. Subsequently, in order to discharge the contents from the container 200, the push button 400 is first pressed. In the case of pressing the push button 400, the piston guide member 550 supporting the push button 400 and the piston 530 coupled to the interior of the piston guide member 550 are moved down together.

Further, as the piston 530 is moved down in the accommodating space S of the housing 510, the contents filled in the accommodating space S sequentially pass through the second contents inlet port 533, the first path 532, the second path 552, the contents outlet port 551, and the nozzle 470 to be discharged to the outside by pressure acting on the accommodating space S.

At this time, the recess 573 of the open and close part 572 comes into close contact with the projection 513 formed on the first contents inlet port 511 by downward pressure exerted by the piston 530, thus preventing the contents in the container 200 from being introduced into the accommodating space S.

As shown in FIG. 6, if the push button 400 is moved up to be restored to its original position by the spring member 590, the piston guide member 550 and the piston rod 531 are moved up and the open and close part 572 of the check valve 570 is moved up by the vacuum pressure. Further, the first contents inlet port 511 is opened and the contents flow along the inflow hole 575 to fill the accommodating space S of the housing 510.

Although the present disclosure was described with reference to specific embodiments, it is apparent to those skilled in the art that the present disclosure may be changed and modified in various ways without departing from the spirit or scope of the present disclosure, which is described in the following claims. Therefore, the variations or modifications fall within the purview of the claims of the present disclosure.

The invention claimed is:

1. A cosmetic container, comprising:

an inner cap coupled to a mouth of the container that accommodates contents therein;

a pump coupled to the inner cap and inserted into the mouth of the container to discharge a fixed amount of contents;

a push button provided in an upper portion of the inner cap, operating the pump by a push operation, and having on a side thereof a nozzle to discharge the contents; and a dip tube coupled at a first end thereof to the pump to communicate therewith and inclined at a second end thereof downwards in a direction of a tip of the nozzle, a tip of the dip tube being disposed on an edge of a bottom surface of the container, wherein the pump further comprises:

a housing formed such that an upper end thereof is coupled to the inner cap and a lower end thereof protrudes to be inserted into the mouth, a first end of the dip tube being coupled to the lower end of the housing to communicate therewith, so that the contents are introduced through a first contents inlet port formed in a bottom surface of the housing into an accommodating space defined in the housing; and a first partition wall having a shape of a hollow pipe and inclined downwards in the direction of the tip of the nozzle extends from the lower end of the housing, and the first end of the dip tube is inserted into the first partition wall, so that the second end of the dip tube is inclined downwards in the direction of the tip of the nozzle and the tip of the dip tube is disposed on the edge of the bottom surface of the container, a first locking device provided in the inner cap and the push button and preventing rotation of the push button by restricting a coupling direction of the push button with respect to the inner cap to one direction; and a second locking device provided in the inner cap and the housing and preventing rotation of the housing by restricting the coupling angle of the housing with respect to the inner cap to one direction.

2. The cosmetic container of claim 1, wherein the first locking device comprises:

a first locking protrusion formed on an outer wall of the push button to protrude outwards in order to fix a position of the push button to the inner cap, and a first locking groove correspondingly formed in an inner wall of the inner cap so that the first locking protrusion is inserted into the first locking groove.

3. The cosmetic container of claim 2, wherein the pump further comprises:

a piston inserted into the upper end of the housing and moving up and down while being in close contact with an inner wall of the housing, a first path being longitudinally defined therein to communicate with the accommodating space; and a piston guide member disposed in the housing such that an upper end thereof supports the push button and a lower end thereof is inserted into the inner cap, and moving up and down along with the piston in a state where an upper end of the piston is inserted into the lower end of the piston guide member, a second path being longitudinally defined in the piston guide member to communicate with the first path, with a contents outlet port being formed on an upper surface of the piston guide member to discharge the contents, a spring member fitted over the piston guide member to elastically support the piston guide member and the push button; and a check valve installed in the housing, and coming into close contact with the bottom surface of the housing to open or close the first contents inlet port.

4. The cosmetic container of claim 3, wherein the inner cap comprises a second partition wall of a hollow pipe shape, the piston guide member being inserted into the second partition wall, a lower end of the second partition wall being disposed inside the housing, and wherein a undercut processing area is formed in the lower end of the piston guide member, a third locking protrusion is formed on a lower end of the undercut processing area and protrudes outwards to be caught by the lower end of the second partition wall, a first cut groove is formed in the lower end of the undercut processing area in a direction from the lower end of the piston guide member to the upper end thereof, and a second cut groove is continuously formed above the first cut groove to be spaced apart therefrom.

5. The cosmetic container of claim 4, wherein the piston comprises:

a piston rod formed in a shape of a column, and having the first path that is longitudinally formed therein and a second contents inlet port that is formed in an outer wall thereof to introduce the contents accommodated in the accommodating space into the first path; and a shield member disposed between the piston guide member and the piston rod, an upper end of the shield member being inserted into the lower end of the piston guide member, an upper end of the piston rod being inserted into a lower end of the shield member, so that the shield member causes the second contents inlet port to be exposed so that the contents are introduced into the second contents inlet port when the piston rod moves down, and the shield member covers the second contents inlet port to prevent the contents from being introduced into the second contents inlet port when the piston rod moves up, wherein a fourth locking protrusion is formed on the lower end of the piston rod, and protrudes outwards to be caught by the lower end of the shield member.

6. The cosmetic container of claim 1, wherein the push button and the housing are coupled to the inner cap by the coupling angles restricted by the first locking device and the second locking device, respectively, so that the direction of the tip of the nozzle and a direction of the tip of the second end of the dip tube are aligned in a same direction.

7. The cosmetic container of claim 1, wherein the first locking device and the second locking device are arranged next to each other in a vertical direction and provided in an opposite direction to the direction of the tip of the nozzle in the inner cap.

8. The cosmetic container of claim 1, wherein:

the first locking device has an uneven structure protruding or indented in a radial direction, and the second locking device has an uneven structure protruding or indented in the vertical direction.

9. The cosmetic container of claim 1, wherein an area where one side of the first locking device provided in the inner cap and another side thereof provided in the push button come into contact forms a curved surface, and an area where one side of the second locking device provided on the inner cap and another side thereof provided in the housing come into contact forms a curved surface.

10. The cosmetic container of claim 1, wherein the second locking device comprises:

a flange having a second locking protrusion that protrudes upwards is formed on the upper end of the housing in order to fix a position of the housing to the inner cap; and a second locking groove is formed in the inner cap so that the second locking protrusion is inserted into the second locking groove.

* * * * *